United States Patent [19]

Tomellini

[11] Patent Number: 4,946,139

[45] Date of Patent: Aug. 7, 1990

[54] OBSTACLE FOR EQUESTRIAN SPORTS, MADE UP OF MODULAR ELEMENTS OF SIMPLE AND RAPID ASSEMBLY, FOR INSTALLATION ON THE EQUESTRIAN FIELD

[76] Inventor: Garzia D. Tomellini, Via Caetana, 13, Rome, Italy

[21] Appl. No.: 381,962

[22] Filed: Jul. 19, 1989

[51] Int. Cl.[5] ..... E04H 17/14

[52] U.S. Cl. ..... 256/64; 256/1; 272/102; 119/29

[58] Field of Search ..... 272/4, 5, 103, 102; 119/29; 256/64, 1

[56] References Cited

U.S. PATENT DOCUMENTS 1,902,995 3/1933 Flynn ..... 119/29
4,368,875 1/1983 Weiss et al. ..... 272/102 X
4,793,288 12/1988 Hoadley ..... 119/29

FOREIGN PATENT DOCUMENTS 1459800 12/1968 Fed. Rep. of Germany ..... 256/64
2048516 3/1971 France ..... 119/29

*Primary Examiner*—Andrew V. Kundrat
*Attorney, Agent, or Firm*—Leonard Bloom

[57] ABSTRACT

This invention concerns a jump for equestrian use composed of modular elements that may be linked together by means of T-joints, all in synthetic resin, preferably polymer, and made in such a way as to provide an easy and rapid connection that is nevertheless sufficiently reliable for practical use.

The jump also comprises a number of horizontal bars, each made of plastic, over the outside of which close-fitting plastic sleeves in the desired colors are slipped, there having been provided special curved saddles to be attached to the uprights, thus supporting the ends of the aforesaid bars.

12 Claims, 3 Drawing Sheets

OBSTACLE FOR EQUESTRIAN SPORTS, MADE UP OF MODULAR ELEMENTS OF SIMPLE AND RAPID ASSEMBLY, FOR INSTALLATION ON THE EQUESTRIAN FIELD

The subject of this patent application is a jump for equestrian use composed of modular elements that are easy and quick to assemble in the field.

The jump according to the invention is composed of modular elements that may be linked together by means of T-joints, all in synthetic resin, preferably polymer, and made in such a way as to provide an easy and rapid connection that is nevertheless sufficiently reliable for practical use.

In equestrian centres, and especially in rings provided specifically for show-jumping purposes, fixed wooden structures are generally used; produced on a small scale by craftsmen, they are subjected to atmospheric conditions which render them susceptible to deterioration, thus necessitating continuous or virtually continuous maintenance.

Such structures, moreover, are presently produced by small-scale industries and each item as a whole, so that they take up a large amount of space and are difficult to transport, added to which their weight means that it is not easy or convenient to move them even from one point to another one close-by when trying to obtain the most suitable position during installation.

The abovementioned susceptibility to deterioration of a fixed structure, made according to the previously mentioned techniques, constitutes an economic burden even when only partial in that the whole structure has to be removed in order to carry out the required repairs and then brought back to its original place of use.

The main aim of the invention is to replace the old equestrian jumps with their wooden uprights and bars, with jumps made from a combination of sections of plastic tubing, produced by means of extrusion or moulding.

The jump in question, being made up of modular elements, is relatively economical due to the fact that it is easy and convenient to install, it can be assembled and used in different places, and the elements of which it is composed may be replaced, not to mention the ease with which the height of the jump may be adjusted.

In a preferred embodiment the obstacle in question consists of the following essential modular elements:

rectilinear sections of tubing made in rigid plastic, by means of extrusion or moulding, to be joined together so as to form the cross-pieces and the uprights;

tubular T-joints moulded in rigid plastic to be inserted at the points of union between the cross-pieces and the uprights;

horizontal curved saddles, moulded in rigid plastic, to be mounted on the posts;

horizontal bars made up of rigid plastic tubes, produced by means of extrusion or moulding, the ends of which are designed to be placed within the concavities of the two opposing saddles attached to the posts of two different uprights.

Particular attention has been paid to the possibility of coupling up the T-joint with the three rectilinear sections of tubing.

In an initial embodiment the sections of tubing are inserted into the T-joint by means of a male-female connection in that each of the three open ends of said joint may be forced inside one end of each of the three aforesaid rectilinear sections of tubing.

In a second embodiment, designed to render the connection between the T-joints and the sections of tubing firmer and more stable, two diametrically opposed transversal ribs have been provided adhering to the outer circumference of the three cylindrical ends of the T-joints, said ribs being designed to click into two corresponding transversal notches of the same shape provided towards the end of each rectilinear section of tubing, once the latter has been attached, by means of a male-female coupling, to one of the aforementioned cylindrical ends of the actual T-joint.

The existence of this additional system of coupling means that the securing of these elements is extremely reliable, thus rendering the overall structure of each upright, wherein such connections between T-joints and straight sections of tubing occur more than once, particularly strong.

At the 90° angles formed between the horizontal and vertical wings of the 'T' the T-joint bears an equal number of gussets moulded together with the rest of the piece and in the same material, equipped with a central hole onto which the corner of a curtain panel may be hooked and thus attached to the side of the upright.

The presence of these gussets which, once the complete structure of the upright has been assembled, find themselves positioned at the four corners of each space delimited by two horizontal and two vertical sections of tubing joined together by the previously mentioned T-joints, is extremely useful for attaching these curtain panels which, at present, have to be held up by additional frames, somehow attached to the side of the uprights, with a much less satisfactory esthetic and functional result.

As another alternative to the joint - rectilinear section of tubing coupling previously suggested, it would also be possible, once the tubing has been fitted onto an end of the joint, to insert a pin that would pass through a set of four aligned holes distributed in pairs and situated at appropriate points at the open ends of the joint and towards the end of the rectilinear section of tubing; in this case also there would be a firm connection between the various elements, although this is perhaps a less practical solution.

The curved saddle upon which the ends of the bars rest has, on its lower vertical bracket, which is shaped so as to correspond with the rounded profile of the post, two protruding pins designed to fit precisely into two corresponding holes provided as part of a whole series of vertically aligned holes on said post.

The two rear extremities of the opposing arms of the saddle, the purpose of said arms being to encircle the sides of the post, are linked by means of a curved metal clip that may be unhooked and that allows the supporting saddle to tightly encircle the entire circumference of the body of the post.

The provision of a pair of pins as opposed to just one and the aforementioned curved clip has been conceived with the aim of rendering the curved saddle stable on its supporting post; to this end, both the role of the double pin inserted into the holes on the post and the role of the curved clip positioned at the rear of said post, may be seen in a positive light, said curved clip tightly encircling the post and thus preventing undesired and troublesome movement on the part of the saddle attachment, even in the event of strong jolts being transmitted from the bar.

Said horizontal bar has also undergone improvements in the field of practicality, above all with regard to its external decoration.

It is in fact well known that the horizontal bars must have alternating sections in different colours; to this end, up until now the bars have always been painted in this manner, or covered with alternating strips of suitably coloured adhesive paper.

In the version of the obstacle according to the invention, several close-fitting plastic sleeves, produced in the desired colours, have been slipped over the outside of a conventional horizontal bar, the colours having been added during extrusion; in order to render such a structure stable, two end plugs are provided with an elongated central body designed to be pushed into the cavity of the actual bar, said plug also having an outer edge of such diameter and shape that it presses against the last of the coloured sleeves on the bar.

For greater clarity of explanation, the description of the invention continues with reference to the enclosed drawings, provided for illustrative and not limitataive purposes, wherein.

Figures 1, 2, 3:
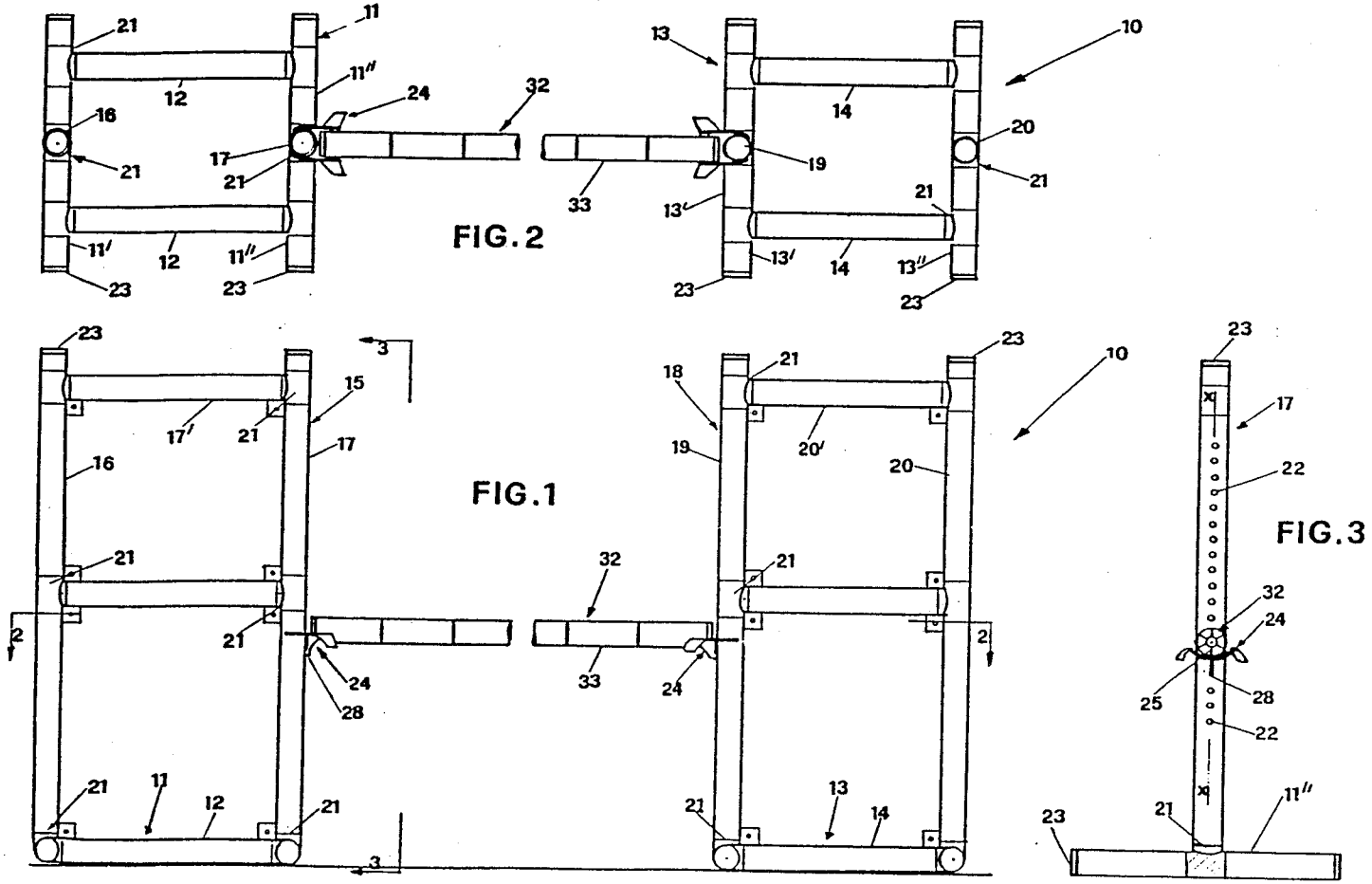
FIG. 1 is a schematic frontal view of an obstacle according to the invention.
FIG. 2 is a schematic plan view of an obstacle according to the invention.
FIG. 3 is a side view of a post belonging to an obstacle according to the invention.

Moving now to the diagrams, and first of all to FIGS. 1 and 3, it can be seen that the jump (10), subject of the invention, is made up of identical lateral uprights, numbered (15) and (18) respectively, placed opposite one another and spaced in such a way as to allow a bar (32) of the desired length to be placed between their respective opposing internal posts (17) and (19). As these two lateral uprights are identical from the structural and functional point of view, the detailed description included herein refers only to the one on the left-hand side, numbered (15).

This upright (15), chosen as the example for the purposes of this description, is composed of a sub-structure of two parallel components (11') and (11") made up of modular tubular elements, axially connected by means of T-joints (21), the opposing transversal branches thereof serving to connect up with the respective ends of parallel modular tubular elements (12) in such a way as to complete the sub-structure (11). Identical T-joints are provided in the middle of the two said parallel components (11') and (11"), so that a branch of each joint serves to connect up with the posts of this lateral section (15), part of structure (10), and in particular posts (16) and (17), positioned respectively on the outside and inside of said structure (10).

The modular elements that go to form posts (16) and (17) are also linked together by means of T-joints (21), the facing branches thereof serving in this case to connect up with opposite ends of the modular tubular transversal elements numbered (17').

In FIG. 3 it is shown how, along the generatrix x—x of the outer tubular surface of post (17), there is a set of equidistant holes (22), spaced according to the required height variations of the bar (32).

Similarly, another set of holes, spaced in the same manner, is provided opposite, on the facing generatrix of post (19), on the right hand upright (18) of the jump (10).

These facing holes serve to adjust the positioning of the respective supports (24) for the bar (32), as will be explained in more detail further on, the desired height being obtained by inserting the two pins (28*a*) and (28*b*) that protrude from the support (24), into a pair of holes (22) on the post (17), and carrying out the same operation with the holes (22) on post (19), in such a way that, although distant from one another, the curved surfaces (25) of these two supports (24) are positioned co-axially and protrude from posts (17) and (19) in opposing directions so that they provide a seat for the ends of the horizontally placed bar (32).

Figure 4:
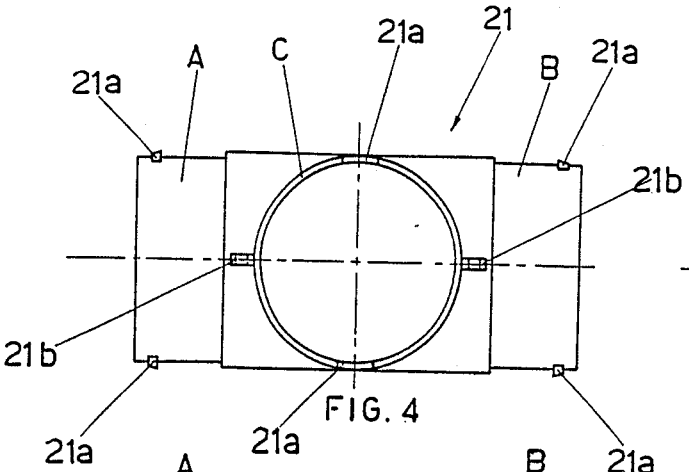
FIG. 4 is a side view of the T-joint.
Figure 5:
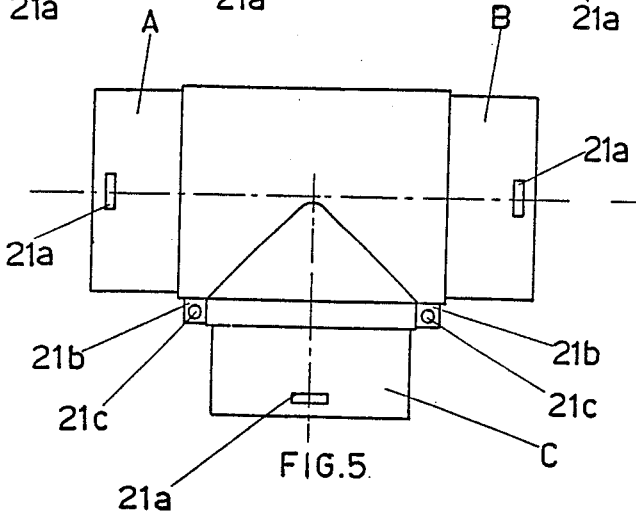
FIG. 5 is an orthogonal projection of FIG. 4.

With reference to FIGS. 4 and 5, on the outside of its three cylindrical tubular ends, be it the opposing longitudinal ones (A) and (B), or the transversal one (C), the T-joint (21) possesses two diametrically opposed transversal ribs (21*a*) that adhere to the curve of the circumference of said ends.

In addition to this, it should be emphasised that on this T-joint (21) there are two gussets (21*b*), made of the same material and moulded together with the rest of the piece, positioned at the 90° angles formed by the horizontal and vertical wings of the "T", said gussets being equipped with a central hole (21*c*) to be used for securing a corner of the curtain panel, in the event of one being used, to the side of the upright.

Figure 6:
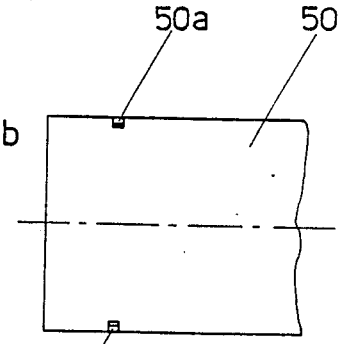
FIG. 6 is a view of the end of a rectilinear section of tubing.
Figure 7:
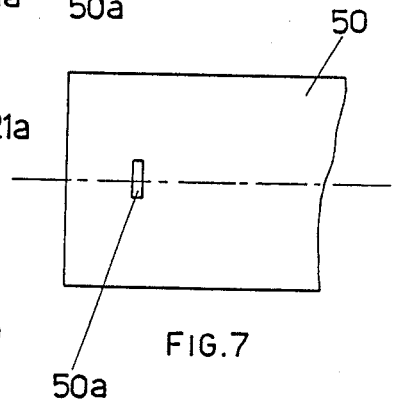
FIG. 7 is an orthogonal projection of FIG. 6

With reference to FIGS. 6 and 7, on the outside of each end of each tubular rectilinear section (50) there is a pair of diametrically opposed transversal notches (50*a*), the same shape as and corresponding to the two ribs (21*a*) present on the outside of the mouth of the T-joint (21); as already mentioned, using slight force and a male-female system of coupling, the mouth of the T-joint (21) is connected up with the end of a rectilinear section of tubing, so that the two pieces click together, in that the ribs (21*a*) on the joint (21) enter and settle firmly inside the corresponding notches (50*a*) of the same shape, in the tube (50).

Figure 8:
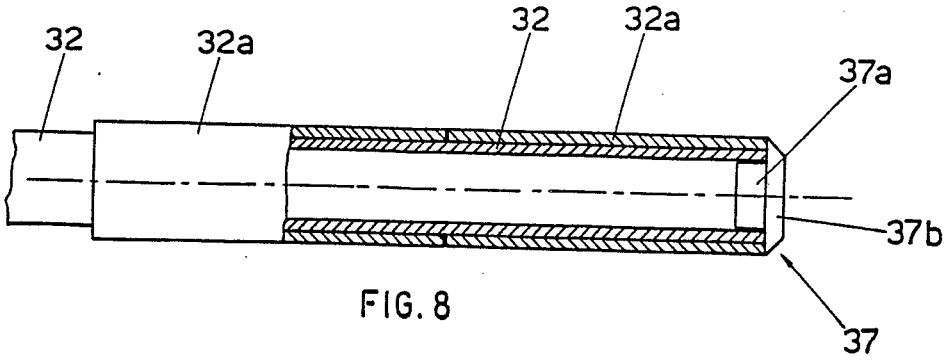
FIG. 8 shows the end section of a bar.

With reference to FIG. 8, close-fitting plastic sleeves (32*a*) in the desired colours have been slipped over the outside of a conventional horizontal bar (32) and are held onto the bar (32) by two end plugs (37) provided for this purpose and comprising an elongated central body (37*a*), designed to be forced into one end of the bar (32) and remain blocked therein, and a head (37*b*) of such diameter that it functions as a stopper for the aforementioned sleeves (32*a*).

Figure 9:
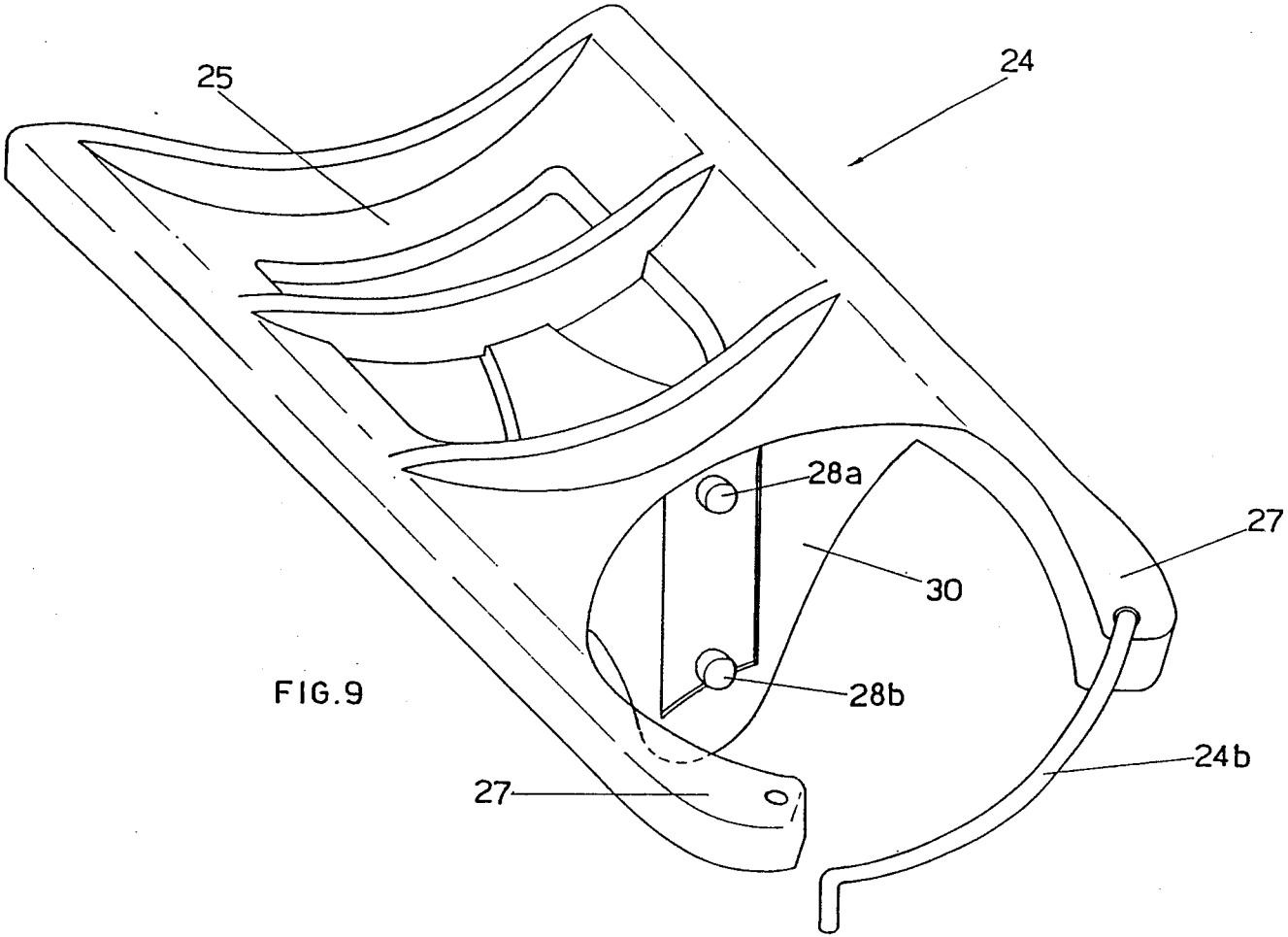
FIG. 9 is an assonometric diagram of the curved supporting saddle.

With reference to FIG. 9, the supporting saddle (24) possesses, below its curved supporting surface (25), a downward facing vertical bracket (30) suitably shaped so as to conform with the rounded profile of the post of the upright, said bracket (30) being equipped on its rear side with two vertically aligned pins (28*a*) and (28*b*), designed to fit exactly through two of the many suitably shaped vertically aligned holes (22) situated along the face of the post.

This supporting saddle (24) has two opposing arms (27) which, in addition to encircling the two sides of the outer perimeter of the post, also act as a support, their rear extremities being composed of a piece of round metal that forms a curved clip (24*b*) that may be unhooked and is made in such a way that it firmly encircles the rear outer perimeter of the post.

I claim:

1. An obstacle for equestrian purposes which is easily assembled in an equestrian ring, comprising:

a first and a second upright support spaced apart from one another;

the first upright support having an inner and an outer spaced apart upright member, the members being substantially parallel to each other, each upright member having a top, a midpoint and a bottom;

a first horizontal supporting member connecting the upright supporting members at the tops thereof, a second horizontal supporting member connecting the midpoints of the upright supporting members;

a base support member perpendicularly connected to bottom of each upright member such that the base supporting members are substantially parallel to one another, at least one base horizontal supporting member connecting the base support members, such that the first upright support is stable and self supporting;

a bar support on the inner upright support member, the bar support being adjustably mounted to be movable between the top and the bottom of the inner upright support member;

the second upright support being substantially identical to the first upright support and disposed such that the respective bar supports are facing one another; and a bar removably disposed on the bar supports on the first and the second upright supports and extending therebetween.

2. The obstacle for equestrian purposes of claim 1, wherein the upright members and the horizontal support members are tubular.

3. The obstacle for equestrian purposes of claim 2, wherein the means for connecting each horizontal support member to the respective upright member comprises a respective T-joint.

4. The obstacle for equestrian purposes of claim 3, wherein each T-joint has three cylindrical ends, each cylindrical end having a pair of diametrically opposed transverse ribs connected thereto; each tubular upright member and each horizontal support member further having an end connecting to a respective cylindrical end of the respective T-joint, the end of each tubular member further having a pair of diametrically opposed transverse notches therein, the notches having the same shape as the respective ribs on the T-joint and cooperating therewith such that the tubular members may be connected to the T-joint by engaging the respective ribs in the respective notches.

5. The obstacle for equestrian purposes of claim 1, further comprising the bar support having a curved supporting surface, a vertical bracket extending downwardly from the curved support, a pair of pins extending horizontally and inwardly from the vertical bracket, a pair of arms extending inwardly from the curved supporting surface such that the arms are disposed on opposite sides of the inner upright support.

6. The obstacle for equestrian purposes of claim 5 further comprising each arm having an end, the end of each arm having a hole therein, a clip having a first end and a second end, the ends being inserted in the respective holes in the arms such that the clip encloses the inner upright support between the arms and secures the bar support to the respective inner upright support.

7. The obstacle for equestrian purposes of claim 5, further comprising, each inner upright support member having a plurality of openings therein, the openings disposed vertically from top to bottom, the openings on the respective inner vertical support members facing one another, the openings being spaced such as to receive and cooperate with the respective pins in the bar support such that the bar support may be adjusted to a desired position on the inner upright support member to support the bar between the upright supports.

8. The obstacle for equestrian purposes of claim 1, further comprising a close fitting plastic sleeve slidably disposed over the bar, the bar having a first end and a second end, a pair of end plugs each having an elongated body and a head inserted in each end of the bar to retain the sleeves on the bar.

9. The obstacle for equestrian purposes of claim 8, wherein the sleeve may be of a desired color.

10. An obstacle for equestrian purposes which is easily assembled in an equestrian ring, comprising:

a first and a second upright support spaced apart from one another;

the first upright support having an inner and an outer spaced apart upright member, the members being substantially parallel to each other, each upright member having a top, a midpoint and a bottom;

a first horizontal supporting member connecting the upright supporting members at the tops thereof, a second horizontal supporting member connecting the midpoints of the upright supporting members;

a base support member perpendicularly connected to bottom of each upright member such that the base supporting members are substantially parallel to one another, at least one base horizontal supporting member connecting the base support members, such that the first upright support is stable and self supporting;

a bar support on the inner upright support member, the bar support being adjustably mounted to be movable between the top and the bottom of the inner upright support member;

the second upright support being substantially identical to the first upright support and disposed such that the respective bar supports are facing one another;

a bar removably disposed on the bar supports on the first and the second upright supports and extending therebetween; the upright members and the horizontal support members being tubular;

the means for connecting each horizontal support member to the respective upright member comprises a respective T-joint;

each T-joint having three cylindrical ends, each cylindrical end having a pair of diametrically opposed transverse ribs connected thereto; each tubular upright member and each horizontal support member further having an end connecting to a respective cylindrical end of the respective T-joint, the end of each tubular member further having a pair of diametrically opposed transverse notches therein, the notches having the same shape as the respective ribs on the T-joint and cooperating therewith such that the tubular members may be connected to the T-joint by engaging the respective ribs in the respective notches;

the bar support having a curved supporting surface, a vertical bracket extending downwardly from the curved support, a pair of pins extending horizontally and inwardly from the vertical bracket, a pair of arms extending inwardly from the curved supporting surface such that the arms are disposed on opposite sides of the inner upright support, each arm having an end, the end of each arm having a hole therein, a clip having a first end and a second end, the ends being inserted in the respective holes in the arms such that the clip encloses the inner upright support between the arms and secures the bar support to the respective inner upright support; and each inner upright support member having a plurality of openings therein, the openings disposed vertically from top to bottom, the openings on the respective inner vertical support members facing one another, the openings being spaced such as to receive and cooperate with the respective pins in the bar support such that the bar support may be adjusted to a desired position on the inner upright support member to support the bar between the upright supports.

11. An obstacle for equestrian purposes which is easily assembled comprising:

a first and a second upright support spaced apart from one another; each support having vertical upright members and horizontal members which are tubular and connected at right angles to each other, by means of a respective T-joint at each connection, the connection comprising the respective T-joint having respective ribs thereon and the respective upright members and respective horizontal members having notches thereon such that the respective ribs cooperate with the respective notches;

a bar support on each upright support such that the respective bar supports are facing each other, the respective bar supports being adjustably mounted for vertical movement on the respective vertical upright member; and a bar removably disposed on the bar support on the first upright support and on the bar support on the second upright support, the bar extending therebetween.

12. The obstacle for equestrian purposes of claim 11, further comprising the bar support having a curved supporting surface, a vertical bracket extending downwardly from the curved support, a pair of pins extending horizontally and inwardly from the vertical bracket, a pair of arms extending inwardly from the curved supporting surface such that the arms are disposed on opposite sides of the vertical upright member, each arm having an end, the end of each arm having a hole therein, a clip having a first end and a second end, the ends being inserted in the respective holes in the arms to secure the bar support to the respective vertical upright member, each respective vertical upright member having a plurality of openings disposed vertically thereon, the openings being spaced apart such as to receive and cooperate with the pins on the vertical bracket such that bar support may be adjusted to a desired position on the vertical upright member to support the bar between the upright supports.

* * * * *